US010008379B1

(12) United States Patent
Marshall

(10) Patent No.: US 10,008,379 B1
(45) Date of Patent: Jun. 26, 2018

(54) INFRARED RECYCLING INCANDESCENT LIGHT BULB

(71) Applicant: Robert A Marshall, Georgetown, TX (US)

(72) Inventor: Robert A Marshall, Georgetown, TX (US)

( * ) Notice: Subject to any disclaimer, the term of this patent is extended or adjusted under 35 U.S.C. 154(b) by 200 days.

(21) Appl. No.: 15/049,751

(22) Filed: Feb. 22, 2016

(51) Int. Cl.
*H01K 1/26* (2006.01)
*H01K 1/14* (2006.01)
*H01K 1/28* (2006.01)
*H01K 1/32* (2006.01)

(52) U.S. Cl.
CPC ..... *H01K 1/26* (2013.01); *H01K 1/14* (2013.01); *H01K 1/28* (2013.01); *H01K 1/325* (2013.01)

(58) Field of Classification Search
CPC ..... H01K 1/26
See application file for complete search history.

(56) References Cited

U.S. PATENT DOCUMENTS 6,087,775 A 7/2000 Levinson
6,979,105 B2 * 12/2005 Leysath ..... B60Q 3/74 257/10
7,368,870 B2 5/2008 Wang
8,823,250 B2 9/2014 Bermel
2012/0286643 A1 11/2012 Ozin
2014/0042890 A1 * 2/2014 Bermel ..... B82Y 20/00 313/110

OTHER PUBLICATIONS

Peter Bermel, et al, "Design and global optimization of high-efficiency thermophotovoltaic systems", Optics Express, vol. 18, No. S3, Sep. 13, 2010, p. A314-A334.
Alfred Thelen, "Design of a hot mirror: contest results", Applied Optics, vol. 35, No. 25, Sep. 1, 1996, p. 4966-4977.
Ognjen Ilic, et al, "Tailoring high-temperature radiation and the resurrection of the incandescent source", Nature Nanotechnology, Jan. 11, 2016, DOI: 10.1038/NNANO.2015.3.
Ognjen Ilic, et al, "Tailoring high-temperature radiation and the resurrection of the incandescent source", Nature Nanotechnology, DOI: 10.1038/NNANO.2015.309.
Alfred Thelen, "Design of a hot mirror: contest results", Aookied Optics, vol. 35, No. 25, Sep. 1, 1996, p. 4966-4977.

* cited by examiner

*Primary Examiner* — Joseph L Williams

(57) ABSTRACT

A high efficiency incandescent light bulb includes a filament both electrically and optically heated to visibly incandesce. The filament is enclosed in a visibly transmissive, IR reflective filter, with a high view factor, as to maximize recycling of IR wavelengths. The filter is formed on two clamshell segments.

28 Claims, 4 Drawing Sheets

INFRARED RECYCLING INCANDESCENT LIGHT BULB

RELATED APPLICATIONS

This is a Continuation In Part of U.S. application Ser. No. 14/274,549, entitled Directional heat exchanger, filed May. 9, 2014; which is a Continuation In Part of U.S. application Ser. No. 10/937,831, entitled Directional heat exchanger, filed Sept. 8, 2004.

BACKGROUND OF THE INVENTION

Incandescent lighting wastes 95% of the input energy as heat. The market has an extreme market need for high efficiency lighting to decrease energy consumption, and reduce greenhouse gases released to the atmosphere. This has led to banning inefficient bulbs in major economies. CFL and LED alternatives suffer from poor quality of light, poor color temperature, poor color rendering, high manufacturing costs, poor life if operated in a fixture with a heat trap, poor efficiency at end of life, flicker, require a power supply since they cannot operate from line voltage, and pose hazardous and electronic waste environmental impacts.

InfraRed Recycling (IRR) coatings have been added to incandescent lights. IR wavelengths are reflected back to reheat the filament, while visible wavelengths pass. Practical limitations have prevented adoption of this approach.

In U.S. Pat. No. 6,087,775, the IRR is formed on a section of an ellipsoid bulb, surrounding an approximately cylindrical filament. However, view factor is poor. There is high light leakage around the filter. Filament centering is a concern. The complexity of the filter is limited, as only simple filters may be practicably formed on a curved bulb.

Alternatively, in U.S. Pat. No. 8,823,250, the IRR may be formed on a flat substrate for use with flat filaments. This allows the use of more complex filters. The view factor is reasonable, but only if the filters are placed so close to the filament as to limit orientation of operation of the lamp to vertical only to prevent a hot filament from sagging into the filter. It also suffers from leakage of light from the sides of the filters.

SUMMARY OF THE INVENTION

In accordance with the present invention, an IRR incandescent light bulb is provided which address disadvantages and problems associated with other systems and methods. Incandescent light bulbs can easily provide a Color Rendering Index of 100, operate directly from line voltage, have low manufacturing cost, are not affected by hot or cold environments, pose no special disposal requirements, have only small variation in light output over life, and have reduced flicker.

An IRR coating is placed on a substrate located near to and surrounding an incandescent filament. Proximity has the advantage of reducing the number of reflections before reabsorption at the filament, thus reducing filter losses and increasing efficiency. Surrounding the emitter minimizes light loss, thus increases efficiency.

The substrate is formed in two parts having a clamshell geometry. This has the advantage of allowing gradient-index thin-film interference IRR filter coatings to be deposited on the first surface of incidence with necessary precision, reducing absorption in the substrate. Another advantage is optically precise coatings are not required to be formed on the inside of a bulb. Yet another advantage is the geometry of the optic reduces the number of reflections before reabsorption. Still another advantage is the range of incident angles is reduced. Additionally, an Anti-Reflective (AR) coating may be included.

Additional IRR coatings may be deposited on second surface of the substrate. Additional concentric substrates may have front and back IRR coatings. An advantage is higher performance IRR filters are possible, while maintaining manufacturability of layer thicknesses and tolerances.

A flat circular filament allows a good view factor with a clamshell filter. The filament is perforated to increase resistivity sufficiently to operate from AC line voltage and to produce a uniform temperature. A flat filament has the disadvantage of a non-uniform radiation pattern arising from two distinct radiating surfaces. A reflector may be used to produce a more typical radiation pattern.

IRR incandescent efficacy may exceed 100 photopic lumens per watt, exceeding both CFL and LED technologies.

Other technical advantages are readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the invention, and for further features and advantages, reference is now made to the following description, taken in conjunction with the accompanying drawings, in which.

DESCRIPTION OF THE PREFERRED EMBODIMENT

The present invention relates to an infrared recycling incandescent light bulb.

Figure 1A:
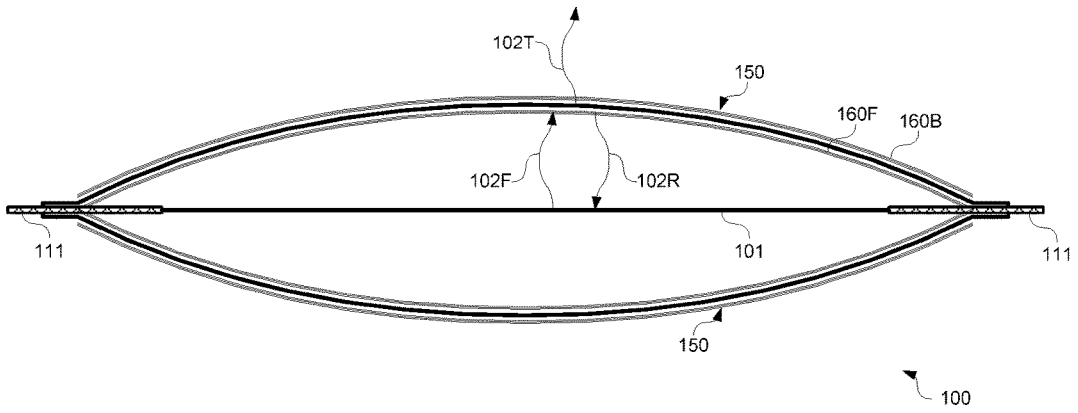
FIG. 1A illustrates the side view of an IRR light source.

FIG. 1A illustrates the side view of an IRR light source 100. Filament 101 is electrically heated to visibly incandesce, producing radiated emissions 102F. Radiated emissions 102F are incident on filter 150. Filter 150 will reflect a portion of the energy, reflected emissions 102R, back to filament 101 for reabsorption and radiative reheating of filament 101; and transmit a portion of the energy as transmitted emissions 102T. This radiative reheating reduces the requirements for electrical heating.

Radiated emissions 102F contain both visible and IR spectra. Preferably, 102T contains only visible spectra, and preferably 102R contains only IR spectra. The effectiveness of this separation of the desired visible spectra and the recycling of the undesired IR spectra determines the efficiency of the bulb. Additionally, UV spectra may also be reflected. Also, the ends of the visible spectrum. may be shaped, at a slight expense of color rendering. In an alternate embodiment, different spectral bands may be tailored, based on the end use application.

To maximize IR recycling, it is important the filter be as sharp and of high of quality as possible.

Filter 150 has a substrate, a front side IRR filter 160F, and/or a back side IRR filter 160B. IRR filter 160F and 160B may contain an interference filter, dielectric filter, rugate filter, gradient index filter, 1D, 2D, or 3D photonic crystal, or any combination of filter elements. IRR filter 160F and 160B may be of different type, materials, or selected for different wavelengths. Gradient index filters are a single layer, with refractive index varying through the depth of the filter. A gradient index filter of the same performance may have a smaller thickness than a comparable dielectric filter.

Filament 101 does not perfectly absorb all reflected emissions 102R. A portion of this energy is reflected by filament 101 back to filter 150, where it is re-reflected back to filament 101. This proceeds as an infinite series, until the energy is either reabsorbed by the filament, transmitted by the filter, absorbed by the filter, ejected out any openings in the filter, or absorbed by filament supports 111. It is preferred filter 150 substantially enclose filament 101 and be shaped and positioned such as to minimize leakage of unfiltered radiation, maximize IR reheating, and to allow operation in any orientation.

View factor is a figure of radiative self-view. I.E. the percent view of the filament, as seen from the filament, via reflections from the filter. Filter 150 may be a concave, two part clamshell. A clamshell may completely enclose the filament, and allow room for filament sag during operation. The number of reflections before incidence is minimized, as compared to high curvature geometries. A large area flat filament 101 intersects a large section of filter 150, reducing the number of reflections before becoming incident on the filament. Sensitivity to position variation due to manufacturing and sag is reduced. Off-axis rays from a Lambertian radiation pattern from a planar emitter are efficiently returned to the filament. View factors exceeding 95% are possible. In an alternate embodiment, cylindrical geometries are possible, but are less preferred, as there are a greater number of reflections before being reabsorbed, resulting in a less efficient bulb.

A clamshell design has a number of manufacturability advantages over cylindrical or spherical shaped designs. High performance interference filters require a large number of layers with tight tolerances, low optical absorption, and must be able to be deposited at a high rate. A two piece clamshell design is compatible with existing planar processes capable of meeting these requirements. Front side IRR filter 160F and/or backside IRR filter 160B are formed on a substrate, resulting in filter 150. Use of multiple filters keeps the thickness and layer count of each filter individually within the limits of manufacturability, allowing the performance of all filters combined to exceed what is possible with a single filter. Preferably, the first filter should reflect wavelengths the substrate material may absorb. The two halves of filter 150 are joined together to fully enclose filament 111.

Figure 1B:
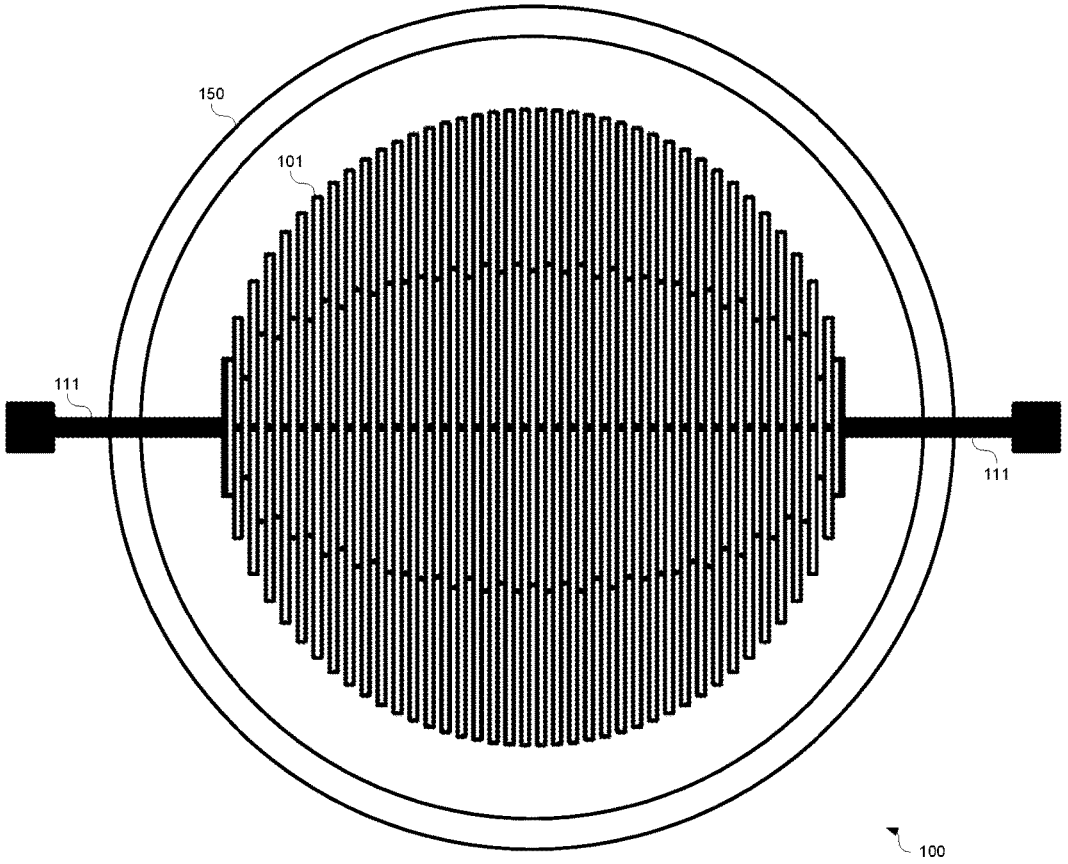
FIG. 1B illustrates the top view of an IRR light source.

FIG. 1B illustrates the top view of an IRR light source 100. Filament 101 is supported by filament supports 111. The two halves of clamshell filter 150 may be crimp sealed at the periphery. The sealing of filter 150 may be done under low pressure, vacuum, or non-atmospheric conditions to avoid the use of a fill tube and associated reduction in view factor. In al alternative embodiment, filter 150 is held together with clips and the proper atmosphere is provided by the outer bulb.

Filament 101 may have a large number of slit perforations to increase the resistance of a Tungsten foil, sheet or film, so it can operate directly from line voltage. The length and position of the slits are selected as to maintain a uniform temperature. The slits may be wedge shaped. Slits are particularly advantageous over a serpentine pattern on a thin foil at high temperature, due to increased mechanical stability. Filament 101 may have a 1D, 2D, or 3D photonic crystal on its surface to suppress IR emission. In an alternate embodiment, the filament may be formed from a ultra high temperature ceramic. Or, the filament may include alternate materials such as Tantalum, Molybdenum, or Platinum.

Incandescent emitters must operate at high temperatures to efficiently produce light. However, high temperatures increase the evaporation rate of Tungsten or other emitter materials, and cause filament failure and bulb darkening. Traditionally, filaments are formed from coils or coils of coils of wire in an Argon or other fill gas. The coil geometry has a distinct advantage from the Langmuir effect. A hot sheath of Argon gas limits evaporation of Tungsten, as Tungsten is evaporated from one position on the coil, it may collide with an Argon and be redeposited elsewhere on the coil. Flat filaments have limited benefit from the Langmuir effect. To maintain equal or greater lifetime, the filament temperature must be reduced. Lower temperatures result in reduced visible emissions, imposing more stringent requirements on the IRR filters. Temperatures as low as 2000K are readily envisioned. Even 1600K is possible. The high temperature operation of incandescent bulbs has the advantage of reducing flicker in the light output, as the thermal mass of the filament helps produce a constant intensity output. Halogen gas may be employed to etch deposits of evaporated filament material from the filter.

Figure 2A:
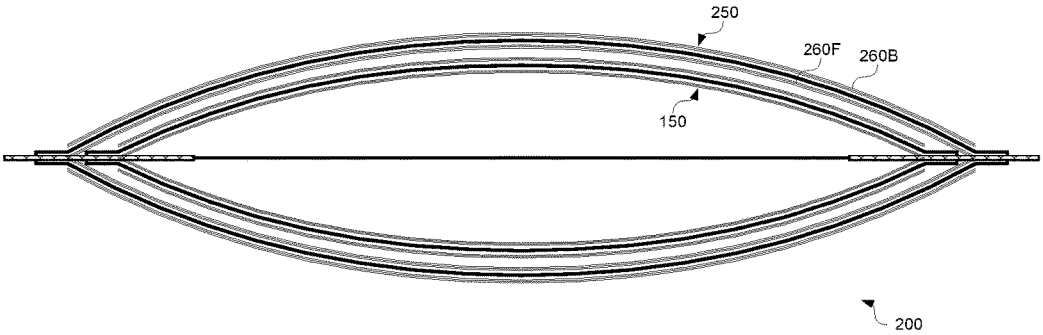
FIG. 2A illustrates the side view of an alternate embodiment of an IRR light source.

FIG. 2A illustrates the side view of an alternate embodiment of an IRR light source 200. In addition to filter 150, filter 250 has a substrate, a front side IRR filter 260F, and/or a backside IRR filter 260B. Filter 250 is slightly larger and generally the same shape as the clamshell in filter 150. Additional layers allow increased performance while maintaining manufacturability. Each IRR filter 150F, 150B, 260F, 260B may be a gradient index filter. Alternatively, each may have several hundred layers and may be many microns thick.

Many existing methods of depositing optical quality thin film layers produce a flux of deposition material from essentially a point source. This leads to a small but non-zero variation in material thickness, measured across the radius of the filter, due to projection of a point source onto a curved surface. The filter may be inclined from normal to the deposition material source, and rotated, as to mechanically integrate the variation in layer thickness due to projection effects.

Figure 3A:
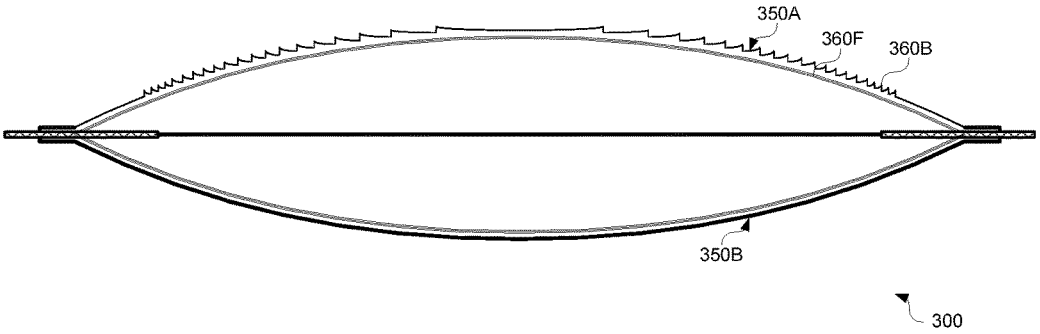
FIG. 3A illustrates the side view of an alternate embodiment of an IRR light source.

FIG. 3A illustrates the side view of an alternate embodiment of an IRR light source 300. A flat filament predominantly radiates from the front and back surfaces, much unlike a coiled filament that radiates in all directions. Filter 350A has a Fresnel lens 360B on its second surface, with an IRR filter 360F on its first surface. Fresnel lens 360B may defocus, as to produce a more uniform radiation pattern. Alternatively, for applications requiring a focused source, Fresnel lens 360B may be selected to focus. In yet other embodiments, other lens shapes may produce the desired radiation pattern. Filter 350B may be a mirror to limit radiation from the bottom of the filament.

Figure 4:
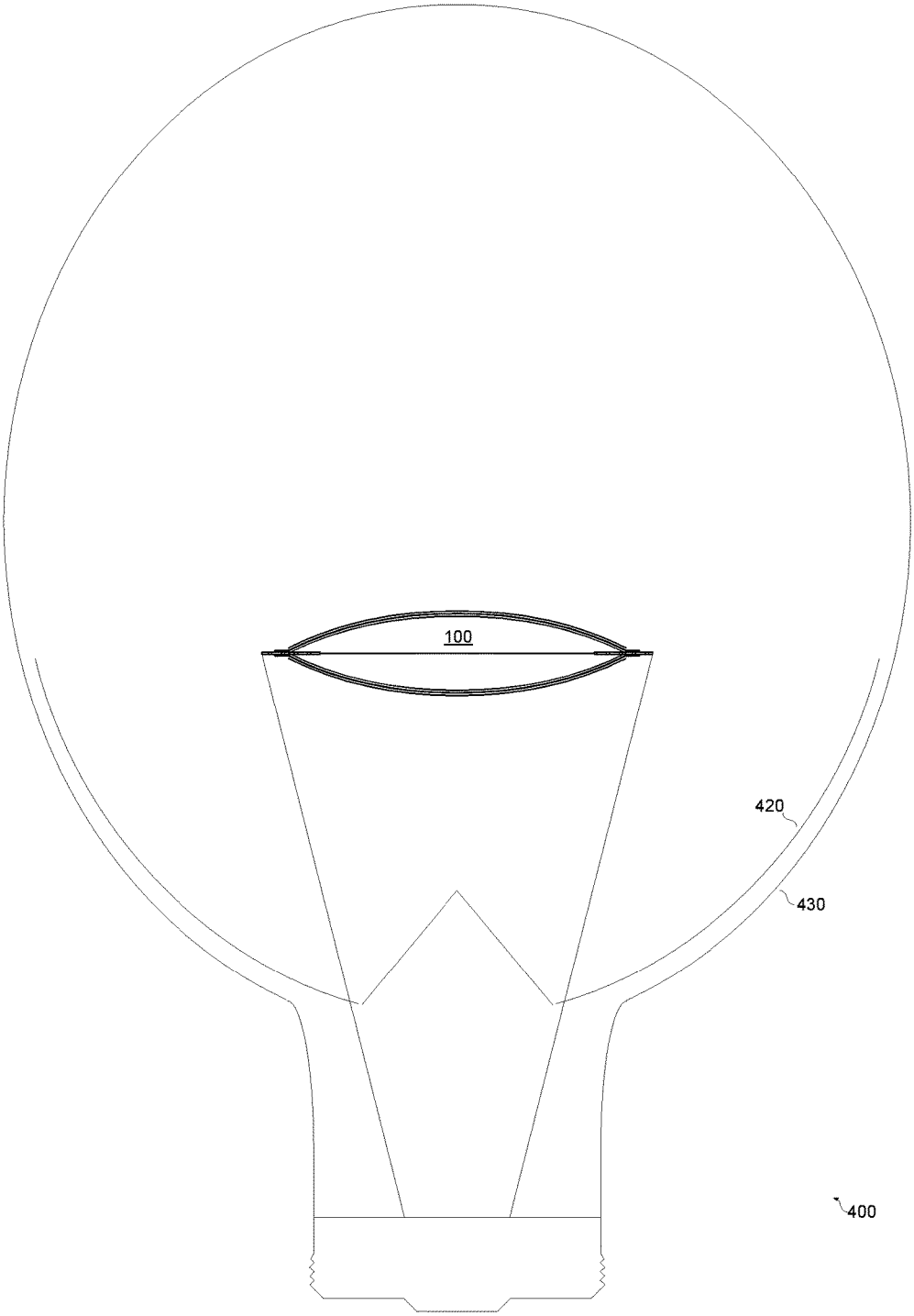
FIG. 4 illustrates the side view of an IRR light source packaged in a bulb.

FIG. 4 illustrates the side view of an IRR light source 100 packaged in a bulb 430. Other embodiments of an IRR light source, such as IRR light source 200 or IRR light source 300, may be used in horizontal or vertical orientation. Reflector 420 redirects downward radiation out of bulb 430. Reflector 420 may have a central cone, as to reduce self illumination of light source 100. Bulb 430 may be vacuum filled, as to reduce conductive losses through a fill gas. Bulb 430 may have the shape of any number of standard industry formats, for instance, A, B, R, BR, PAR, or many others.

Figure 5:
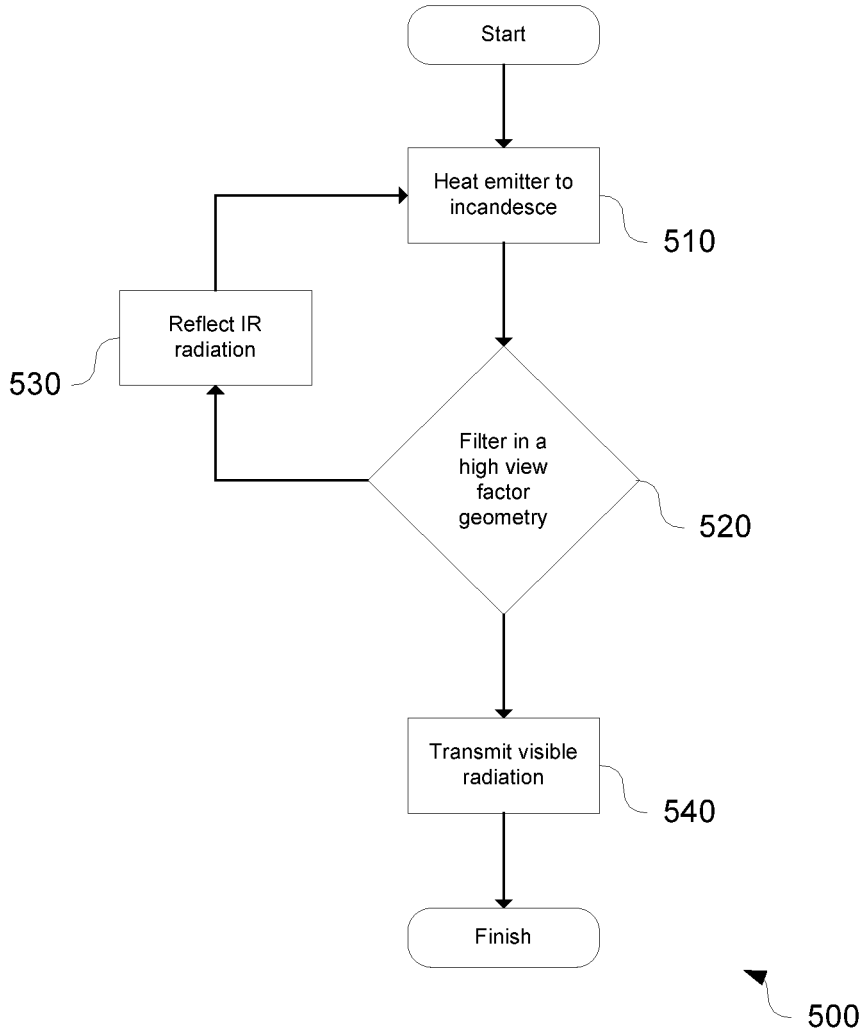
FIG. 5 illustrates a method of infrared recycling.

FIG. 5 illustrates a method of infrared recycling 500. In step 510, an emitter is electrically heated to incandesce. In step 520 the radiation is filtered in a high radiative self-view factor geometry. In step 530, infrared wavelengths are reflected back to reheat the emitter. In step 540, visible wavelengths are transmitted. The filtering may include two opposing filter segments of the same shape and size enclosing the emitter in a high view factor geometry. The uniformity of the electrical heating is increased by perforating the emitter.

U.S. application Ser. No. 10/937,831 is incorporated by continuation in part. It discloses: An infrared recycling incandescent emitter (see FIG. 1, emissions from an emitter are incident on an optical filter, with some wavelengths being recycled) comprising: a thermally stimulated radiative emitter (see para 31, lines 7-8, "source emitter 101 is constructed . . . of a radiative material"); a photonic filter (see para 39, line 11 "optical filter"); the filter is selected to reflect infrared wavelengths back to the emitter (see FIG. 3, R1 is reflective in the infrared spectrum) and to transmit visible light (see FIG. 3, R1 is approximately zero in the visible spectrum); and the filter geometry is selected to provide the emitter with a high radiative self-view factor (see FIG. 1, source emitter 101 in relation to light limiting device 150).

Although embodiments of the system and method of the present invention have been illustrated in the accompanying drawings and described in the foregoing detailed description, it will be understood that the invention is not limited to the embodiment disclosed, but is capable of numerous rearrangements, modifications, and substitutions without departing from the spirit of the invention as set forth and defined by the following claims.

What is claimed is:

1. An infrared recycling incandescent emitter comprising:
a thermally stimulated radiative emitter;
a photonic filter;
the filter is selected to reflect infrared wavelengths back to the emitter and to transmit visible light; and
the filter geometry is selected to provide the emitter with a high radiative self-view factor.

2. The infrared recycling emitter of claim 1, wherein the radiative emitter is disposed within a first envelope and a first filter; and the photonic filter includes the first a filter disposed on one side of the first envelope.

3. The infrared recycling emitter of claim 2, wherein the filter is a gradient index filter.

4. The infrared recycling emitter of claim 2, wherein the first envelope includes two or more opposing segments of similar shape and size, substantially in contact at the periphery of the segments.

5. The infrared recycling emitter of claim 4, wherein the segments are sealed under non-atmospheric conditions.

6. The infrared recycling emitter of claim 4, wherein the envelope segments are clamshell shaped.

7. The infrared recycling emitter of claim 2, wherein a second filter is disposed on the opposite side of the first envelope.

8. The infrared recycling emitter of claim 2, wherein the first envelope is substantially disposed within a second envelope, in a high-view factor geometry; and
a third filter is disposed on one side of the second envelope.

9. The infrared recycling emitter of claim 2, wherein the filters are disposed with respect to the radiative emitter to assure a view factor higher than 85%, and to allow operation of the filament in any orientation.

10. The infrared recycling emitter of claim 4, wherein the filters are disposed with respect to the radiative emitter to assure a view factor higher than 95%, and to allow operation of the filament in any orientation.

11. The infrared recycling emitter of claim 2, wherein the envelope is disposed within a vacuum filled light bulb.

12. The infrared recycling emitter of claim 2, wherein a mirror is disposed on a surface of the envelope.

13. The infrared recycling emitter of claim 2, wherein the infrared recycling emitter and a reflector are disposed within a light bulb.

14. The infrared recycling emitter of claim 2, wherein any of the filters includes an interference filter, dielectric filter, rugate filter, gradient index filter, 1D, 2D, or 3D photonic crystal.

15. The infrared recycling emitter of claim 14, wherein the filter composition, patterning, and geometry are selected such that the infrared recycling emitter has:
a luminous efficacy of greater than or equal to 45 lumens per watt with a radiative emitter temperature less than or equal to 2600K.

16. The infrared recycling emitter of claim 14, wherein the filter composition, patterning, and geometry are selected such that the infrared recycling emitter has:
luminous efficacy of greater than or equal to 80 lumens per watt with a radiative emitter temperature less than or equal to 2500K.

17. The infrared recycling emitter of claim 14, wherein the filter composition, patterning, and geometry are selected such that the infrared recycling emitter has:
luminous efficacy of greater than or equal to 100 lumens per watt with a radiative emitter temperature less than or equal to 2500K.

18. The infrared recycling emitter of claim 14, wherein the filter composition, patterning, and geometry are selected such that the infrared recycling emitter has:
luminous efficacy of greater than or equal to 130 lumens per watt with a radiative emitter temperature less than or equal to 2700K.

19. The infrared recycling emitter of claim 14, wherein the filter also reflects UV emissions.

20. The infrared recycling emitter of claim 1, wherein the radiative emitter has an approximately flat circular shape.

21. The infrared recycling emitter of claim 1, wherein the radiative emitter includes perforations.

22. The infrared recycling emitter of claim 1, wherein the radiative emitter is at least partially composed of an ultra high temperature ceramic.

23. The infrared recycling emitter of claim 1, wherein the radiative emitter is operable directly off of line voltage.

24. A method of infrared recycling, comprising:
electrically heating an emitter to incandesce;
filtering the radiation with a photonic filter in a high radiative self-view factor geometry with the emitter;
reflecting infrared radiation back to the emitter; and
transmitting visible radiation.

25. The method of claim 24, wherein the filtering includes two opposing filter segments of the same shape and size enclosing the emitter.

26. The method of claim 24, wherein the uniformity of the electrical heating is increased by perforating the emitter.

27. The method of claim 24, wherein the infrared radiation is sufficiently reflected and the visible radiation sufficiently transmitted as to have a luminous efficacy of greater than or equal to 45 lumens per watt with an emitter temperature less than or equal to 2700K.

28. An infrared recycling incandescent emitter comprising:

a thermally stimulated radiative emitter having an approximately flat circular shape and perforated surface is disposed within an envelope;

a photonic filter is disposed on the envelope;

the filter is selected to reflect infrared wavelengths back to the emitter and to transmit visible light;

the filter geometry is selected to provide the emitter with a high radiative self-view factor;

the envelope includes two opposing segments of similar shape and size, substantially in contact at the periphery of the segments;

the filter composition, patterning, and geometry are selected such that the infrared recycling emitter has:

luminous efficacy of greater than or equal to 45 lumens per watt with a radiative emitter temperature less than or equal to 2700K.

* * * * *